US012291317B2

(12) United States Patent
Wilson

(10) Patent No.: US 12,291,317 B2
(45) Date of Patent: May 6, 2025

(54) SYSTEM AND METHOD FOR CONTROLLED HORIZONTAL BUOYANCY

(71) Applicant: Timothy D. Wilson, Clinton, MD (US)

(72) Inventor: Timothy D. Wilson, Clinton, MD (US)

( * ) Notice: Subject to any disclaimer, the term of this patent is extended or adjusted under 35 U.S.C. 154(b) by 611 days.

(21) Appl. No.: 17/676,635

(22) Filed: Feb. 21, 2022

(65) Prior Publication Data

US 2023/0182874 A1 Jun. 15, 2023

Related U.S. Application Data

(60) Provisional application No. 63/287,824, filed on Dec. 9, 2021.

(51) Int. Cl.
*B63C 9/20* (2006.01)
*B63C 9/105* (2006.01)

(52) U.S. Cl.
CPC ..... *B63C 9/20* (2013.01); *B63C 9/1055* (2013.01)

(58) Field of Classification Search
CPC .. B63C 9/00; B63C 9/20; B63C 9/105; B63C 9/1055; B63C 9/11; B63C 9/125; B63C 9/13; B63C 9/15; B63C 9/155; B63C 9/18
USPC ..... 441/80, 88, 89, 90, 92, 96
See application file for complete search history.

(56) References Cited

U.S. PATENT DOCUMENTS

| | | | | |
|---|---|---|---|---|
| 9,439,460 | B2 * | 9/2016 | Richards | A41D 13/0007 |
| 9,868,495 | B2 * | 1/2018 | Schechter | G16H 20/30 |
| 9,963,210 | B1 * | 5/2018 | Ebot | A41D 13/0051 |
| 10,414,475 | B2 * | 9/2019 | Sunol | B63C 9/1255 |
| 10,518,853 | B2 * | 12/2019 | Cuesta Zavala | B63C 9/20 |
| 10,589,828 | B1 * | 3/2020 | Sexton | B63C 9/1255 |
| 11,155,325 | B2 * | 10/2021 | Garner | B63C 9/081 |
| 11,851,149 | B2 * | 12/2023 | Shoham | B63C 9/105 |

* cited by examiner

*Primary Examiner* — Daniel V Venne
(74) *Attorney, Agent, or Firm* — Jordan IP Law, LLC

(57) ABSTRACT

An aquatic system is provided for use with an object. The aquatic system includes: a parameter detector being configured to detect a parameter of the object and to output an activation signal based on the detected parameter; an inflatable bladder being configured to inflate with a gas to displace a volume of water when the object is in the water; a memory having instructions stored therein; and a stabilization controller being configured execute the instructions to cause the inflatable bladder to inflate so as to establish horizontal buoyancy of the object based on the activation signal.

10 Claims, 8 Drawing Sheets

SYSTEM AND METHOD FOR CONTROLLED HORIZONTAL BUOYANCY

The present application claims priority from U.S. Provisional Application No. 63/287,824 filed Dec. 9, 2021, the entire disclosure of which is incorporated herein by reference.

BACKGROUND

Embodiments of the invention relate to floatation systems.

SUMMARY

An aspect of the present disclosure is drawn to an aquatic system for use with an object. The aquatic system includes: a parameter detector being configured to detect a parameter of the object and to output an activation signal based on the detected parameter; an inflatable bladder being configured to inflate with a gas to displace a volume of water when the object is in the water; a memory having instructions stored therein; and a stabilization controller being configured execute the instructions to cause the inflatable bladder to inflate so as to establish horizontal buoyancy of the object based on the activation signal.

In some embodiments of this aspect, the aquatic system is for use with a person as the object, wherein the aquatic system further includes: a suit configured to substantially cover the person between a knee and a head, wherein the parameter detector comprises a biometric parameter detector configured to detect a biometric parameter of the person, the biometric parameter detector being disposed at the suit, wherein the inflatable bladder is disposed at the suit, wherein the memory is disposed at the suit, and wherein the stabilization controller is disposed at the suit. In some of these embodiments, the system further includes: a second inflatable bladder disposed at the suit and being configured to inflate with a second gas to displace a second volume of water when the person is in the water, wherein the stabilization controller is additionally configured to cause the second inflatable bladder to inflate so as to establish the horizontal buoyancy of the person. In some of these embodiments, the inflatable bladder is disposed at the suit at one location of a group of locations consisting of a first area near a chest of the person, a second area near a stomach of the person, a third area near a back of the person, a fourth area near a front of a thigh of the person, and a fifth area near a back of a thigh of the person, and the second inflatable bladder is disposed at the suit at a different one location of the group of locations.

In some embodiments of this aspect, the aquatic system is for use with a person as the object, wherein the aquatic system further includes: a second inflatable bladder configured to inflate with a second gas to displace a second volume of water when the person is in the water; a first attachment piece configured to detachably fasten the inflatable bladder to the person at one location of a group of locations consisting of a first area near a chest of the person, a second area near a stomach of the person, a third area near a back of the person, a fourth area near a front of a thigh of the person, and a fifth area near a back of a thigh of the person; and a second attachment piece configured to detachably fasten the second inflatable bladder to the person at a different one location of the group of locations, wherein the stabilization controller is additionally configured to cause the second inflatable bladder to inflate so as to establish the horizontal buoyancy of the person. In some of these embodiments, the aquatic system further includes a third inflatable bladder, wherein the suit is additionally configured to substantially cover the person between an ankle and the head, and wherein the third inflatable bladder is disposed at the suit at one location of the ankle.

In some embodiments of this aspect, the biometric parameter detector is configured to detect, as the biometric parameter, at least one parameter of the group of parameters comprising body temperature, blood pressure, heart rate, salt concentration, a change in body temperature, a change in blood pressure, a change in heart rate, a change in salt concentration, and combinations thereof. In some of these embodiments, the biometric parameter detector is configured to output the activation signal when a value of the detected biometric parameter meets a predetermined threshold value.

In some embodiments of this aspect, the stabilization controller is additionally configured to: cause the inflatable bladder to inflate an initial amount so as to establish an initial negative horizontal buoyancy of the object so as to cause the object to horizontally sink in the water; and subsequently cause the inflatable bladder to inflate a subsequent amount so as to establish a subsequent zero horizontal buoyancy of the object so as to cause the object to maintain a horizontal position at a predetermined depth in the water.

In some embodiments of this aspect, the aquatic system further includes: a first radio configured to transmit the activation signal; a second radio configured to receive the activation signal; a first attachment piece housing the parameter detector and the first radio and being configured to detachably fasten to the object at a first location; a second attachment piece housing the stabilization controller and the second radio and being configured to detachably fasten to the object; and a third attachment piece being configured to detachably fasten the inflatable bladder to the object at a second location.

Another aspect of the present disclosure is drawn to a method of using an aquatic system for use with an object. The method includes: detecting, via a parameter detector, a parameter of the object; outputting, via the parameter detector, an activation signal based on the detected parameter; causing, via a stabilization controller configured to execute instructions stored on a memory, an inflatable bladder, configured to inflate with a gas to displace a volume of water when the object is in the water, to inflate so as to establish horizontal buoyancy of the object based on the activation signal.

In some embodiments of this aspect, the method is for use with person as the object, wherein detecting the parameter of the object comprises detecting, via a biometric parameter detector, a biometric parameter of the person, and wherein the biometric parameter detector is disposed at a suit configured to substantially cover the person between a knee and a head. In some of these embodiments, the method further includes causing, via the stabilization controller configured to execute instructions stored on a memory, a second inflatable bladder, disposed at the suit and being configured to inflate with a second gas to displace a second volume of water when the person is in the water, to inflate so as to establish the horizontal buoyancy of the person. In some of these embodiments, the inflatable bladder is disposed at the suit at one location of a group of locations consisting of a first area near a chest of the person, a second area near a stomach of the person, a third area near a back of the person, a fourth area near a front of a thigh of the person, and a fifth area near a back of a thigh of the person, and the second inflatable bladder is disposed at the suit at a different one location of the group of locations. In some of these embodiments, the method further includes causing, via the stabilization controller, a second inflatable bladder, configured to inflate with a second gas to displace a second volume of water when the person is in the water, to inflate when the person is in the water so as to establish the horizontal buoyancy of the person, wherein a first attachment piece detachably fastens the inflatable bladder to the person at one location of a group of locations consisting of a first area near a chest of the person, a second area near a stomach of the person, a third area near a back of the person, a fourth area near a front of a thigh of the person, and a fifth area near a back of a thigh of the person, and wherein a second attachment piece detachably fastens the second inflatable bladder to the person at a different one location of the group of locations.

In some embodiments of this aspect, the detecting the biometric parameter comprises detecting, as the biometric parameter, at least one parameter of the group of parameters comprising body temperature, blood pressure, heart rate, salt concentration, a change in body temperature, a change in blood pressure, a change in heart rate, a change in salt concentration, and combinations thereof. In some of these embodiments, the outputting the activation signal comprises outputting the activation signal when a value of the detected biometric parameter meets a predetermined threshold value.

In some embodiments of this aspect, the method further includes: causing, via the stabilization controller, the inflatable bladder to inflate an initial amount so as to establish an initial negative horizontal buoyancy of the object so as to cause the object to horizontally sink in the water; and subsequently causing, via the stabilization controller, the inflatable bladder to inflate a subsequent amount so as to establish a subsequent zero horizontal buoyancy of the object so as to cause the object to maintain a horizontal position at a predetermined depth in the water.

In some embodiments of this aspect, the method further includes: transmitting, via a first radio, the activation signal; and receiving, via a second radio, the activation signal, wherein a first attachment piece houses the parameter detector and the first radio and detachably fastens to the object at a first location, wherein a second attachment piece houses the stabilization controller and the second radio and detachably fastens to the object, and wherein a third attachment piece detachably fastens the inflatable bladder to the object at a second location.

BRIEF SUMMARY OF THE DRAWINGS

The accompanying drawings, which are incorporated in and form a part of the specification, illustrate example embodiments and, together with the description, serve to explain the principles of the invention. In the drawings.

DETAILED DESCRIPTION

With very few exceptions, everyone floats, however most people think they are that exception when in reality 99.9% are not. It is the degree of flotation and how easy it is to float that is influenced by your body's make-up. People usually float to varying degrees and in varying ways.

In general, fat people float better than lean people. However, it is a person's overall composition, not necessarily their size, that dictates their buoyancy and how well they will float in water. The higher a person's body fat percentage is the easy it will be for them float.

A very closely related (but slightly different) subject that determines how well people float is the questions of displacement. Displacement is simply the amount of something (in this case, water) that you displace (or take the place of). When a person jumps into a body of water, they displace an amount of water that is equal to the mass of their body under the water. When they are immersed in water, they experience a buoyant force equal to the weight of the water they have displaced. So if a person weighs 300 pounds and displace 300 pounds of water, they will have a gravitation force of 300 pounds pulling them down while 300 pounds of buoyant force will push them up. In other words, the person will have achieved equilibrium and will float.

However, just because a person floats, they still may eventually drown, if their orientation in the water changes such that they cannot breathe. This will be described in greater detail with reference to FIGS. 1A-D.

Figure 1A:
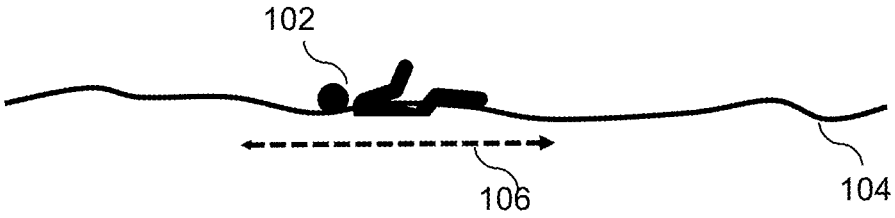
FIG. 1A illustrates a person generally horizontal in water at time $t_0$.

FIG. 1A illustrates a person 102 generally horizontal in water 104 at time $t_0$. As shown in the figure, person 102 has a generally horizontal orientation along the surface of the water as indicated by dashed double arrow 106. There may be instances when person becomes over exerted, has a heart issue, becomes hypothermic, or succumbs to some malady that prevents person 102 from maintaining a horizontal orientation. At this point, because people have multiple pendulums and their natural tendency is to walk and swim up right or in a vertical posture, person 102 may eventually start to rotate into a vertical position.

Figure 1B:
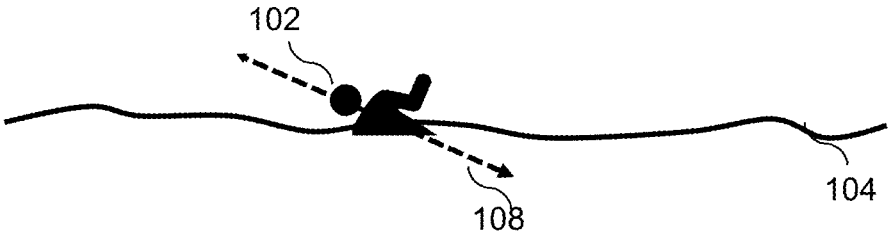
FIG. 1B illustrates the person of FIG. 1A starting to rotate in water at time $t_1$.

FIG. 1B illustrates person 102 starting to rotate in water 104 at time $t_1$. As shown in the figure, after some time, person 102 is unable to maintain a horizontal orientation and they start to rotate as indicated by dashed double arrow 108.

Figure 1C:
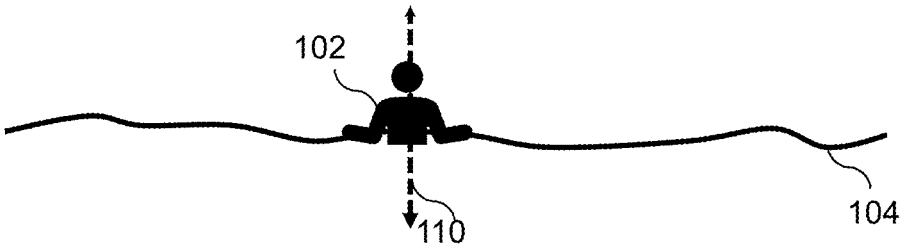
FIG. 1C illustrates the person of FIG. 1A being generally vertical in water at time $t_2$.
Figure 1D:
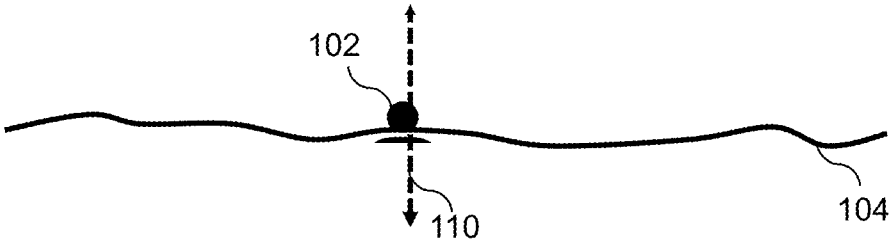
FIG. 1D illustrates the person of FIG. 1D starting to sink in water at time $t_3$.

Eventually, as shown in FIG. 1C, person 102 has rotated to a generally vertical orientation in water 104 at time $t_2$, as indicated by dashed double arrow 110. Finally, as shown in FIG. 1D, person 102 starts to sink in water 104 at time $t_3$, which may lead to drowning.

What is needed is a system and method for enabling a user to maintain a positive buoyancy in a horizontal orientation.

A system and method in accordance with the present disclosure enables a user to maintain a positive buoyancy in a horizontal orientation.

In accordance with the present disclosure a system, worn by a user, enables a user in water to maintain a positive buoyancy in a horizontal orientation by inflating a system of bladders by an amount of gas based on the body mass index (BMI) of the user.

BMI is a value derived from the mass (weight) and height of a person. The BMI is defined as the body mass divided by the square of the body height, and is expressed in units of kg/m2, resulting from mass in kilograms and height in meters. The BMI may be determined using a table[a] or chart which displays BMI as a function of mass and height. BMI is used as a proxy for the mass and volume of the user to determine buoyancy of the user.

Buoyancy is an upward force exerted by a fluid that opposes the weight of a partially or fully immersed object. In a column of fluid, pressure increases with depth as a result of the weight of the overlying fluid. Thus the pressure at the bottom of a column of fluid is greater than at the top of the column. Similarly, the pressure at the bottom of an object submerged in a fluid is greater than at the top of the object. The pressure difference results in a net upward force on the object. The magnitude of the force is proportional to the pressure difference, and is equivalent to the weight of the fluid that would otherwise occupy the submerged volume of the object, i.e. the displaced fluid.

For this reason, an object whose average density is greater than that of the fluid in which it is submerged tends to sink. If the object is less dense than the liquid, the force can keep the object afloat. This can occur only in a non-inertial reference frame, which either has a gravitational field or is accelerating due to a force other than gravity defining a "downward" direction. In accordance with the present disclosure, the BMI of the user is used as a proxy for the volume and mass of the user to determine the latent buoyancy of the user.

With the BMI, a lookup table is used to associate the BMI with the required additional gas that will be needed to inflate the system of bladder in order to maintain positive (meaning the user will float and will not sink) buoyancy with a horizontal orientation.

An example system and method for enabling a user to maintain a positive buoyancy in a horizontal orientation in accordance with aspects of the present disclosure will now be described in greater detail with reference to FIGS. 2A-4.

Figure 2A:
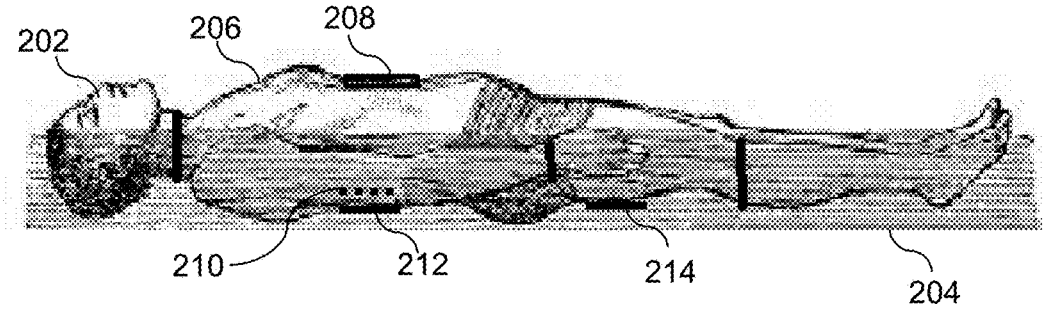
FIG. 2A illustrates a person, using a system in accordance with aspects of the present disclosure, generally horizontal in water at time $t_4$.

FIG. 2A illustrates a user 202, using a suit 206 in accordance with aspects of the present disclosure, generally horizontal in water 204 at time $t_4$. As shown in the figure, suit 206 includes a cummerbund 208, an inflatable bladder 210, an inflatable bladder 212, and an inflatable bladder 214. It should be noted that suit 206 includes a gas supply, a valve controller, a valve system, and a gas distribution system (not shown), which will be further described later.

A Center of Gravity (CoG) is a common term for stability in flying and diving. A positive CoG means the head and body posture is above water. The angle or posture of the body is ideal if the CoG is positive, or forward, as necessary to maintain the head and chest being stable. This will ensure that user 202 does not take on water necessarily from the back or stomach position. The CoG should be negative, or rearward, user 202 is positioned on his back. Suit 206 enables positive CoG or negative CoG as needed based on whether user 202 is face-down in water 204 or face-up in water 204.

In operation, a controller (not shown) in cummerbund 208 will inflate inflatable bladder 210, inflatable bladder 212, and inflatable bladder 214 so as to maintain a horizontal buoyancy. This will be described with reference to FIG. 2B.

Figure 2B:
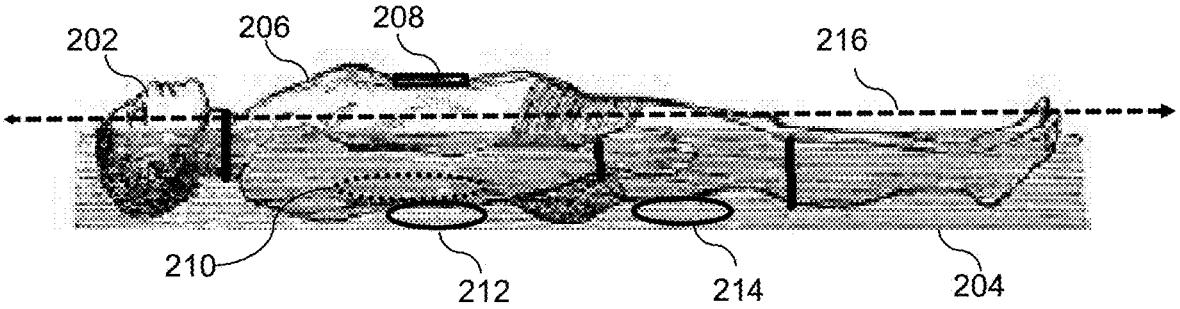
FIG. 2B illustrates the person of FIG. 2A maintaining horizontal buoyancy in accordance with aspects of the present disclosure at time $t_5$.

FIG. 2B illustrates user 202 maintaining horizontal buoyancy in accordance with aspects of the present disclosure at time $t_5$. As shown in the figure, inflate inflatable bladder 210, inflatable bladder 212, and inflatable bladder 214 have been inflated, which displaces more water. As such, user 202 maintains a horizontal buoyancy as indicated by dotted double arrow 216. In particular, the natural buoyancy of person provided by their BMI is supplemented with the positive buoyancy created by the water displaced by the inflation of inflate inflatable bladder 210, inflatable bladder 212, and inflatable bladder 214.

Figure 3:
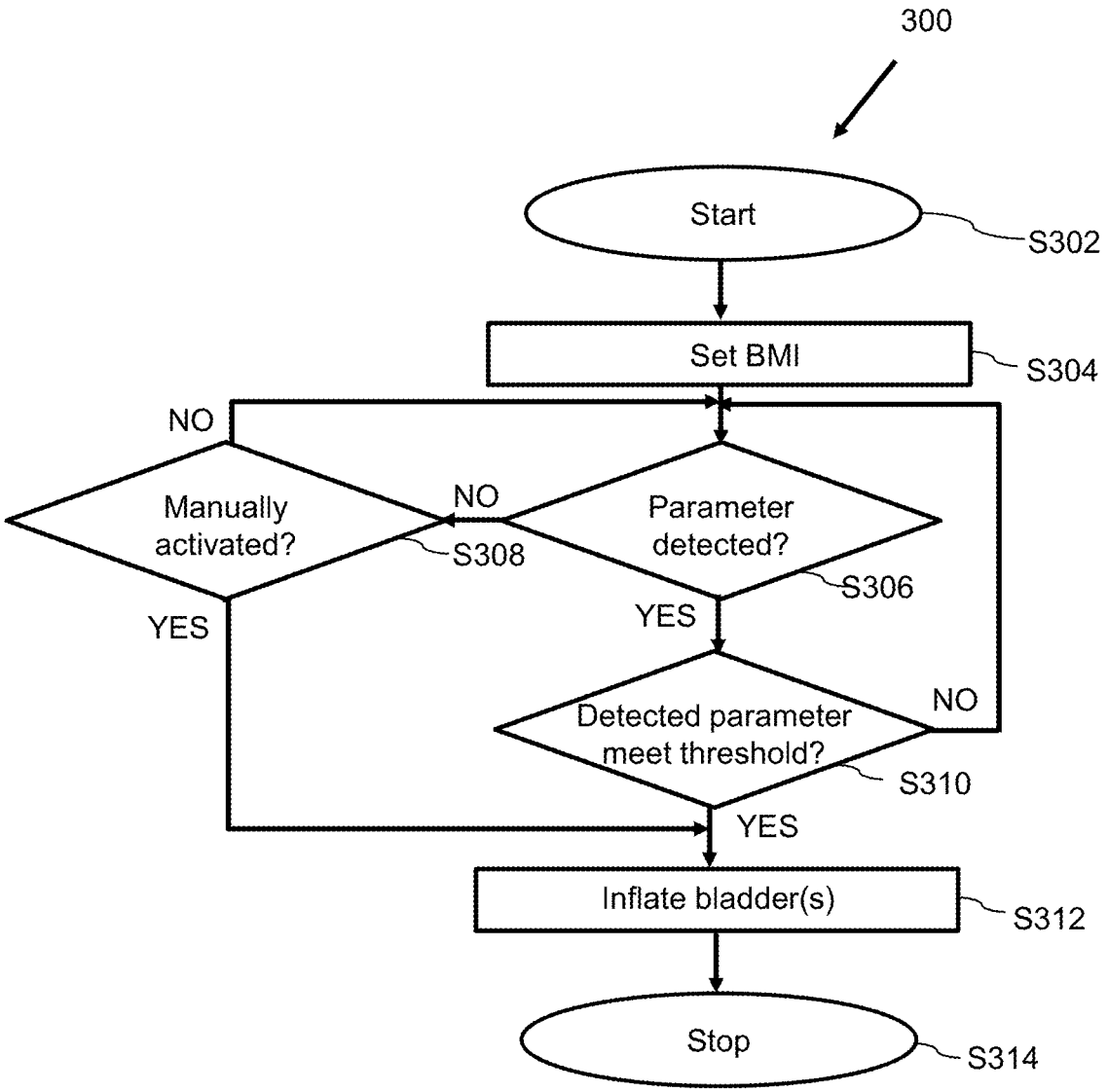
FIG. 3 illustrates a non-limiting example method of maintaining horizontal buoyancy in accordance with aspects of the present disclosure.

FIG. 3 illustrates a non-limiting example method 300 of maintaining horizontal buoyancy in accordance with aspects of the present disclosure.

As shown in the figure, method 300 starts (S302) and a BMI of the user is set (S306). This will be described in greater detail with reference to FIGS. 4A-B.

Figure 4A:
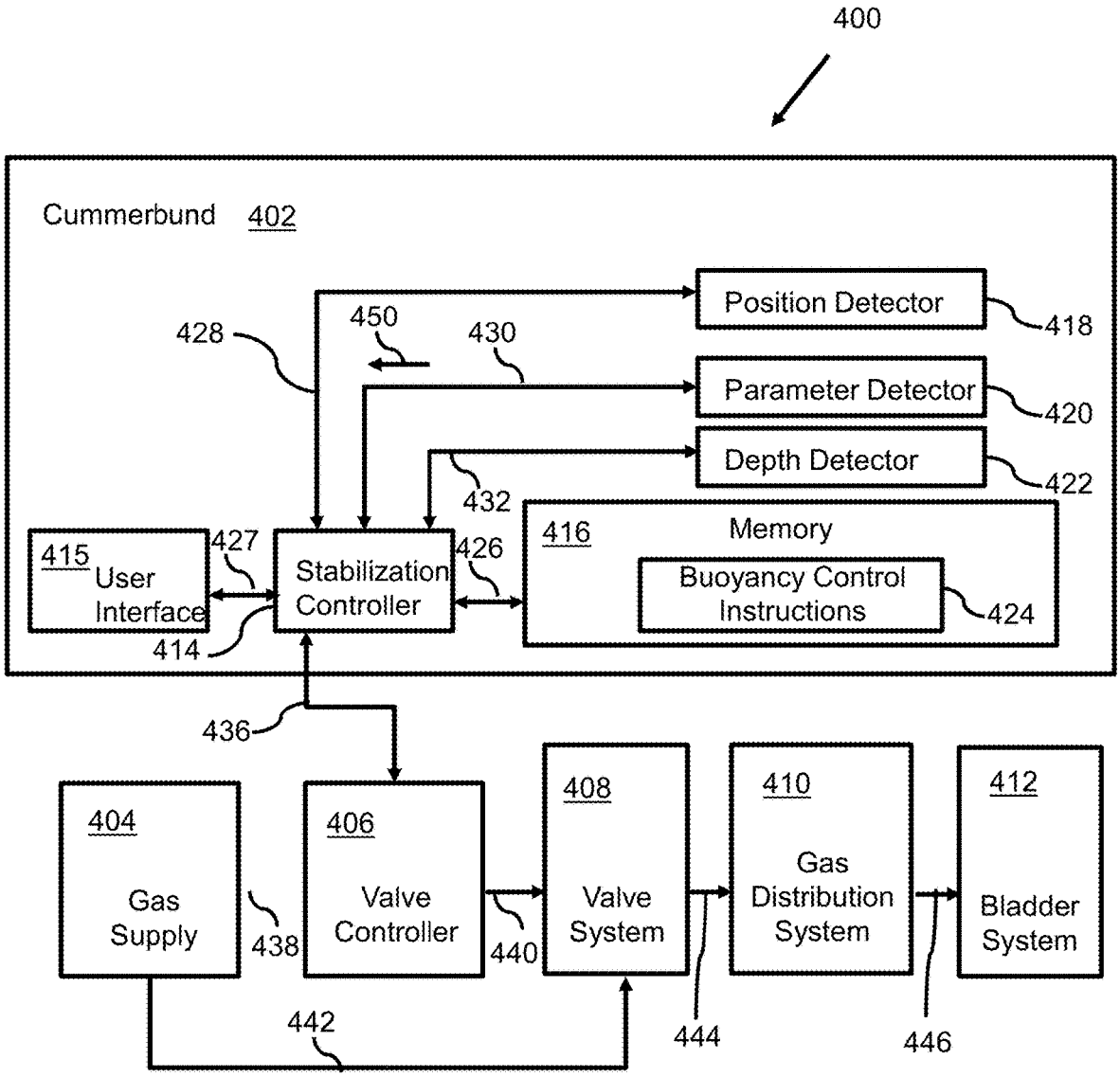
FIG. 4A illustrates an example system for maintaining horizontal buoyancy in accordance with aspects of the present disclosure.

FIG. 4A illustrates an example system 400 for maintaining horizontal buoyancy in accordance with aspects of the present disclosure.

As shown in the figure, system 400 includes a cummerbund 402, a gas supply 404, a valve controller 406, a valve system 408, a fluid distribution system 410, and a bladder system 412. Cummerbund 402 includes a stabilization controller 414, a user interface (UI) 415, a memory 416, a position detector 418, a parameter detector 420, and a depth detector 422.

Memory 416 includes data and instructions to be executed by stabilization controller 414. Of the instructions, memory 416 includes buoyancy control instructions 424 that when executed by stabilization controller 414, cause system 400 to operate in accordance with aspects of the present disclosure.

Stabilization controller 414 is arranged to communicate with memory 416 via a communication channel 426, to communicate with UI 415 via a communication channel 427, to communicate with position detector 418 via a communication channel 428, to communicate with parameter detector 420 via a communication channel 430, to communicate with depth detector 422 via a communication channel 432, and to communicate with valve controller 406 via a communication channel 436.

Valve controller 406 is additionally arranged to communicate with gas supply 404 via a communication channel 438 and to communicate with valve system 408 via a communication channel 440.

Gas supply 404 is additionally arranged to provide gas to valve system 408 via a gas supply line 442.

Valve system 408 is additionally arranged to provide gas to gas distribution system 410 via a gas supply line 444.

Gas distribution system 410 is additionally arranged to provide gas to bladder system 412 via gas supply line 446.

In this example, stabilization controller 414, memory 416, position detector 418, parameter detector 420, and depth detector 422 are illustrated as individual devices. However, in some embodiments, at least two of stabilization controller 414, memory 416, position detector 418, parameter detector 420, and depth detector 422 may be combined as a unitary device. Whether as individual devices or as combined devices, stabilization controller 414, memory 416, position detector 418, parameter detector 420, and depth detector 422 may be implemented as any combination of an apparatus, a system and an integrated circuit. Further, in some embodiments, stabilization controller 414 may be implemented as a computer having non-transitory computer-readable media for carrying or having computer-executable instructions or data structures stored thereon. Such non-transitory computer-readable recording medium refers to any computer program product, apparatus or device, such as a magnetic disk, optical disk, solid-state storage device, memory, programmable logic devices (PLDs), DRAM, RAM, ROM, EEPROM, CD-ROM or other optical disk storage, magnetic disk storage or other magnetic storage devices, or any other medium that can be used to carry or store desired computer-readable program code in the form of instructions or data structures and that can be accessed by a general-purpose or special-purpose computer, or a general-purpose or special-purpose processor. Disk or disc, as used herein, includes compact disc (CD), laser disc, optical disc, digital versatile disc (DVD), floppy disk and Blu-ray disc. Combinations of the above are also included within the scope of computer-readable media. For information transferred or provided over a network or another communications connection (either hardwired, wireless, or a combination of hardwired or wireless) to a computer, the computer may properly view the connection as a computer-readable medium. Thus, any such connection may be properly termed a computer-readable medium. Combinations of the above should also be included within the scope of computer-readable media.

Example tangible computer-readable media may be coupled to a processor such that the processor may read information from, and write information to the tangible computer-readable media. In the alternative, the tangible computer-readable media may be integral to the processor. The processor and the tangible computer-readable media may reside in an integrated circuit (IC), an application specific integrated circuit (ASIC), or large scale integrated circuit (LSI), system LSI, super LSI, or ultra LSI components that perform a part or all of the functions described herein. In the alternative, the processor and the tangible computer-readable media may reside as discrete components.

Example tangible computer-readable media may be also be coupled to systems, non-limiting examples of which include a computer system/server, which is operational with numerous other general purpose or special purpose computing system environments or configurations. Examples of well-known computing systems, environments, and/or configurations that may be suitable for use with computer system/server include, but are not limited to, personal computer systems, server computer systems, thin clients, thick clients, handheld or laptop devices, multiprocessor systems, microprocessor-based systems, set-top boxes, programmable consumer electronics, network PCs, minicomputer systems, mainframe computer systems, and distributed cloud computing environments that include any of the above systems or devices, and the like.

Such a computer system/server may be described in the general context of computer system-executable instructions, such as program modules, being executed by a computer system. Generally, program modules may include routines, programs, objects, components, logic, data structures, and so on that perform particular tasks or implement particular abstract data types. Further, such a computer system/server may be practiced in distributed cloud computing environments where tasks are performed by remote processing devices that are linked through a communications network. In a distributed cloud computing environment, program modules may be located in both local and remote computer system storage media including memory storage devices.

Components of an example computer system/server may include, but are not limited to, one or more processors or processing units, a system memory, and a bus that couples various system components including the system memory to the processor.

The bus represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnects (PCI) bus.

A program/utility, having a set (at least one) of program modules, may be stored in the memory by way of example, and not limitation, as well as an operating system, one or more application programs, other program modules, and program data. Each of the operating system, one or more application programs, other program modules, and program data or some combination thereof, may include an implementation of a networking environment. The program modules generally carry out the functions and/or methodologies of various embodiments of the application as described herein.

In this example, cummerbund 402, gas supply 404, valve controller 406, valve system 408, gas distribution system 410, and bladder system 412 are illustrated as individual devices. However, in some embodiments, at least two of cummerbund 402, gas supply 404, valve controller 406, valve system 408, gas distribution system 410, and bladder system 412 may be combined as a unitary device. Whether as individual devices or as combined devices, cummerbund 402, gas supply 404, valve controller 406, valve system 408, gas distribution system 410, and bladder system 412 may be implemented as any combination of an apparatus, a system and an integrated circuit. Further, in some embodiments, valve controller 406 may be implemented as a computer having non-transitory computer-readable media for carrying or having computer-executable instructions or data structures stored thereon.

Each of stabilization controller 414 and valve controller 406 may be implemented as a hardware processor such as a microprocessor, a multi-core processor, a single core processor, a field programmable gate array (FPGA), a microcontroller, an application specific integrated circuit (ASIC), a digital signal processor (DSP), or other similar processing device capable of executing any type of instructions, algorithms, or software for controlling the operation and functions of the system 400 in accordance with the embodiments described in the present disclosure.

Figure 4B:
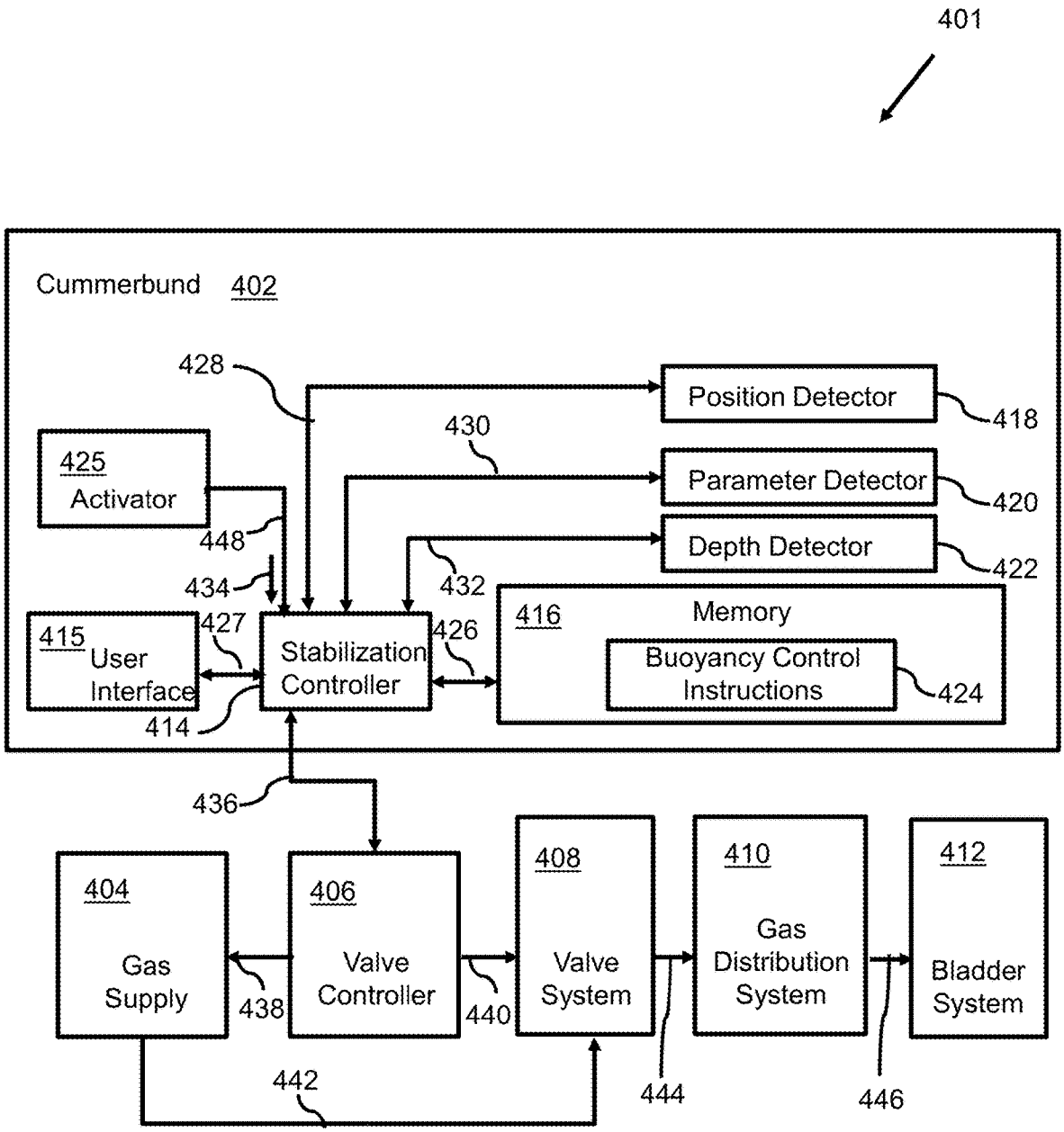
FIG. 4B illustrates another example system for maintaining horizontal buoyancy in accordance with aspects of the present disclosure.

FIG. 4B illustrates an example system 401 for maintaining horizontal buoyancy in accordance with aspects of the present disclosure. System 401 includes all the elements of system 400 discussed above with reference to FIG. 4A, but further includes an activator 425. Activator 425 is arranged to communicate with stabilization controller 414 via a communication channel 434.

In this example, stabilization controller 414, UI 415, memory 416, position detector 418, parameter detector 420, depth detector 422, and activator 425 are illustrated as individual devices. However, in some embodiments, at least two of stabilization controller 414, memory 416, position detector 418, parameter detector 420, depth detector 422, and activator 425 may be combined as a unitary device. Whether as individual devices or as combined devices, stabilization controller 414, memory 416, position detector 418, parameter detector 420, depth detector 422, and activator 425 may be implemented as any combination of an apparatus, a system and an integrated circuit. Further, in some embodiments, at least one of stabilization controller 414 and activator 425 may be implemented as a computer having non-transitory computer-readable media for carrying or having computer-executable instructions or data structures stored thereon.

Cummerbund 402 may be made of any known flexible material that is able to house stabilization controller 414, memory 416, position detector 418, parameter detector 420, and depth detector 422 and to affix to user 202. In some embodiments, cummerbund 402 is integrated into suit 206.

Memory 416 may be any device or system that is configured to store data and instructions to be executed by stabilization controller 414. As will be described in greater detail below, in some embodiments, buoyancy control instructions 424 include instructions, that when executed by stabilization controller 414, cause stabilization controller 414 to cause bladder system 414 to inflate so as to establish horizontal buoyancy of the object, with which system 400 is associated, based on an activation signal received from parameter detector 420.

Further, in some embodiments, as will be described in greater detail below, in some embodiments, buoyancy control instructions 424 include instructions, that when executed by stabilization controller 414, cause stabilization controller 414 to: cause the bladder system 412 to inflate an initial amount so as to establish an initial negative horizontal buoyancy of the object, with which system 400 is associated, so as to cause the object to horizontally sink in the water; and subsequently cause bladder system 412 to inflate a subsequent amount so as to establish a subsequent zero horizontal buoyancy of the object so as to cause the object to maintain a horizontal position at a predetermined depth in the water.

UI 415 may be any device or system that is configured to enable a user to access and control stabilization controller 414. UI 415 may include one or more layers including a human-machine interface (HMI) machines with physical input hardware such a keyboards, mice, game pads and output hardware such as computer monitors, speakers, and printers. Additional UI layers in UI 415 may interact with one or more human senses, including: tactile UI (touch), visual UI (sight), and auditory UI (sound).

Position detector 418 may be any device or system that is configured to detect at least one of: a position of cummerbund 402 relative to a bladder in bladder system 412; a position of a bladder in bladder system 412 relative to a position of cummerbund 402; a pitch, roll and yaw of cummerbund 402; a pitch, roll and yaw of a bladder in bladder system 412; a change in position of cummerbund 402 relative to a bladder in bladder system 412; a change in position of a bladder in bladder system 412 relative to a position of cummerbund 402; a change in pitch, roll and yaw of cummerbund 402; and a change in pitch, roll and yaw of a bladder in bladder system 412. Non-limiting examples of position detector 418 include gyroscopes and accelerometers.

Parameter detector 420 may be any device or system that is configured to detect a parameter of the object, with which system 400 is associated, and to output the activation signal based on the detected parameter. In some embodiments, as will be described in greater detail below, parameter detector 420 may be a biometric parameter detector configured to detect a biometric parameter of the person. Still further, in some of these embodiments, as will be described in greater detail below, parameter detector 420, as a biometric parameter detector, is configured to detect at least one parameter of the group of parameters comprising body temperature, blood pressure, heart rate, salt concentration, a change in body temperature, a change in blood pressure, a change in heart rate, a change in salt concentration, and combinations thereof. Additionally, in some of these embodiments, as will be described in greater detail below, parameter detector 420, as a biometric parameter detector, is configured to output the activation signal when a value of the detected biometric parameter meets a predetermined threshold value. Non-limiting examples of parameter detector 420 include thermometers, pulse oximeters, and heart rate detectors.

Depth detector 422 may be any device or system that is configured to determine a depth of system 400 from the surface of the water, where system 400 is submerged in the water. A non-limiting example of depth detector 422 includes a pneumofathometer.

Activator 425 may be any device or system that is configured to output an activation signal based on activation, such as a manual activation with a button or a wireless activation provided by a receiver receiving an activation signal from an external device.

Gas supply 404 may be any device or system that is configured to provide gas, non-limiting examples of which include canisters of mercury, nitrogen, carbon dioxide, oxygen, helium, or hydrogen.

Valve controller 406 may be any device or system that is configured to control valve system 408.

Valve system 408 may be any device or system that is configured to provide a controlled amount of gas received from gas supply 404 to gas distribution system 410. Valve system 408 may include an integer number of valves which permit gas to flow into gas distribution system so as to ultimately inflate bladders in bladder system 412 and which permit gas to flow from gas distribution system so as to ultimately deflate bladder in bladder system 412.

Gas distribution system 410 may be any device or system that is configured to provide gas to bladder system 412 to maintain horizontal buoyancy. In some embodiments, gas distribution system 410 includes a network of flexible hoses, a non-limiting example of which includes plastic hoses.

Bladder system 412 may be any device or system that is configured to inflate with a gas to displace a volume of water when the object, with which system 400 is associated, is in the water. In an example embodiment, the bladder system is disposed on a suit to be worn by a person, wherein the bladder system includes a first bladder disposed at one location of a group of locations consisting of a first area near a chest of a person, a second area near a stomach of the person, a third area near a back of the person, a fourth area near a front of a thigh of the person, and a fifth area near a back of a thigh of the person, and wherein a second inflatable bladder is disposed at the suit at a different one location of the group of locations.

In operation, the BMI of user 202 is used as a proxy to determine mass and volume of water that would be displaced by user 202 when in water. Further, when filled with gas, any bladders in bladder system will displace additional water so as to increase buoyancy of user 202. More importantly, as shown in FIG. 2B, the buoyancy of the leg of user 202 will be supplemented by bladder 214 (and a similar bladder on the leg not shown in FIG. 2B). Similarly, the buoyancy of the arm of user 202 will be supplemented by bladder 212 (and a similar bladder on the arm not shown in FIG. 2B). Further, the buoyancy of the torso of user 202 will be supplemented by bladder 210.

The amount of inflation of each of bladders 210, 212, and 214 to maintain horizontal buoyancy of a person varies with the BMI of the person. As such, a data structure, such as a look-up table, may be stored in memory 416 that associates an amount of gas needed to inflate of each of bladders 210, 212, and 214 to maintain horizontal buoyancy with a particular BMI. User interface 415 enables user 202 to enter their BMI into memory 416.

Once set in memory 416, when needed, stabilization controller will be able to access memory 416 to determine the amount of gas needed for each bladder to maintain horizontal buoyancy of user 202 based on the BMI of user 202.

Returning to FIG. 3, after the BMI is set (S304), it is determined whether a parameter is detected (S306). In operation, returning to FIG. 2A, suppose for purposes of discussion, that user 202 is in water 204 and user 202 is unable to swim. This inability to swim may be because they are over-exerted, they are going into shock as a result of hyperthermia, or they are having a cardiac issue. The safety of user 202 is paramount and they might not be able to maintain horizontal buoyancy. In a worst case scenario, user 202 might drown in the event that user 202 does not maintain horizontal buoyancy with their head facing upward to easily breathe.

In such a situation, returning to FIG. 4A, parameter detector 420 is configured to detect a parameter associated with a person's inability to swim. As mentioned above, parameter detector 420 is able to detect many types of parameters. For example, in some embodiments, parameter detector 420 includes a thermometer to detect the body temperature of user 202.

Parameter detector 420 then outputs a parameter detection signal, which includes a value of the detected parameter, to stabilization controller 414. In some embodiments, parameter detector 420 is configured to output a parameter detection signal at periodic intervals, a non-limiting example of which includes 30 second intervals. In some embodiments, parameter detector 420 is configured to output a parameter detection signal when a detected parameter value surpasses a predetermined threshold. For example, in the case of a thermometer, in these embodiments, parameter detector 420 may be configured to output a parameter detection signal only when the person's detected body temperature drops below 97° F.

Returning to FIG. 3, if it is determined that a parameter is not detected (NO at S306), then it is determined whether the system is manually activated (S308). For example, a user may manually activate the system. This will be described in greater detail with reference to FIG. 4B.

As shown in FIG. 4B, activator 425 may provide an activation signal 448 to stabilization controller 414. In operation, suppose for purposes of discussion, that user 202 is again in water 204. In this case however, suppose that user 202 wants to maintain horizontal buoyancy, and does not wish wait until they are unable to maintain a horizontal buoyancy on their own. In such a situation, person may activate activator 425, for example by pushing a button on suit 206. By activating activator 425, activation signal 448 is provided to stabilization controller 414.

Returning to FIG. 3, if it is determined that that system is not manually activated (NO at S308), then method 300 again determines whether a parameter is detected (return to S306). However, if it is determined that the system is manually activated (YES at S308), then a bladder(s) is (are) inflated (S312). For example, as shown in FIG. 4B, the bladders in bladder system 412 are inflated.

It should be noted that in some embodiments, manual operation may be performed without any electrical components. For example, a user may manually operate a system in an emergency, wherein a primary battery such as a lithium battery, in conjunction with a back-up power supply, which may take the form of another battery or a photovoltaic system, may be used to inflate bladders if needed.

In particular, upon receiving activation signal 448 from activator 425, stabilization controller 414 will access memory 416 to determine the amount of gas needed to be provided to the bladders within bladder system 412 so as to maintain a horizontal buoyancy for user 202, based on the BMI of user 202.

Stabilization controller 414 will than transmit a valve control signal 450 instruct valve controller 406 to inflate the bladders in bladder system 412. Further, valve control signal 450 will indicate how much gas should be supplied to each bladder, respectively, to maintain horizontal buoyancy of user 202.

Valve controller 406 will instruct gas supply 404 to supply gas to valve system 408. Valve controller 440 will additionally instruct the required valves in valve system 408 to open to supply gas from gas supply 404 to gas distribution system 410. Once in gas distribution system 410, the gas is then provided to bladders within bladder system 412. The bladders in bladder system 412 are then inflated, for example as shown in FIG. 2B.

Returning to FIG. 3, after a bladder(s) is (are) inflated (S312), method 300 stops (S314). At this point, suit 206 will be able to maintain horizontal buoyancy of user 202.

Returning to FIG. 3, if it is determined that a parameter is detected (YES at S306), it is determined whether the value of the detected parameter meets a predetermined threshold (S310).

In some embodiments, as discussed above and shown in FIG. 4A, parameter detector 420 may only report a detected parameter value when the value of the detected parameter exceeds a predetermined threshold. In these embodiments, the reported detected parameter value provided is included in an activation signal 450 by parameter detector 420.

In some embodiments, as discussed above and shown in FIG. 4A, parameter detector 420 may periodically report a detected parameter value. In these embodiments, the reported detected parameter value provided is included in an activation signal 450 by parameter detector 420. Upon receiving the detected parameter value from parameter detector 420, stabilization controller 414 will access memory 416 to obtain the predetermined threshold value associated with the detected parameter. Stabilization controller 414 will then determine whether detected parameter value from parameter detector 420 exceeds the predetermined threshold value.

Further it should be noted that, as mentioned above, parameter detector 420 may detect multiple parameters. As such, in embodiments wherein parameter detector 420 may only report a detected parameter value when the value of the detected parameter exceeds a predetermined threshold, parameter detector 420 may be configured to report when any of the detected parameter values exceed a respective predetermined threshold.

Still further, in some of these embodiments, parameter detector 420 may be configured to report when a combination of detected parameter values correlates with a predetermined signature that is associated with user 202 not being able to maintain horizontal buoyancy. For example, a combination of: a slightly decreased heartrate, which by itself would not exceed a predetermined heartrate threshold to cause activation; with a slightly lowered body temperature, which by itself would not exceed a predetermined body temperature threshold, might together be predetermined to be a signature indicating that user 202 is going into shock and will shortly be unable to maintain horizontal buoyancy.

Similarly, in embodiments wherein parameter detector 420 periodically reports a detected parameter value, stabilization controller 414 may be configured to execute instructions in buoyancy control instructions 424 to determine when any of the detected parameter values exceed a respective predetermined threshold. Additionally, in some of these embodiments, stabilization controller 414 may be configured to execute instructions in buoyancy control instructions 424 to report when a combination of detected parameter values correlates with a predetermined signature that is associated with user 202 not being able to maintain horizontal buoyancy.

Returning to FIG. 3, if it is determined that the value of the detected parameter does not meet the predetermined threshold (NO at S310), then method 300 again determines whether a parameter is detected (return to S306). However, if it is determined that the value of the detected parameter does meet the predetermined threshold (YES at S310), then then a bladder(s) is (are) inflated (S312). This may be performed in a manner as discussed above.

In particular, upon receiving activation signal 450 from activator 425, or in embodiments wherein stabilization controller 414 determines that a detected parameter exceeds a predetermined threshold, stabilization controller 414 will access memory 416 to determine the amount of gas needed to be provided to the bladders within bladder system 412 so as to maintain a horizontal buoyancy for user 202, based on the BMI of user 202.

After a bladder(s) is (are) inflated (S312), method 300 stops (S314).

In the above discussed embodiments with reference to FIGS. 2A-4B, bladder system 412 includes bladder located at the torso of user 202, at the legs of user 202 and at the arms of user 202. It should be noted that any number of bladders may be used in accordance with aspects of the present disclosure. If additional, or less, bladders are used, then the information in memory 416 will be accordingly updated to associate the bladders used with the BMI of user 202 to maintain horizontal buoyancy.

In the above discussed embodiments with reference to FIGS. 2A-4B, system 400 and system 401 are associated with suit 200. It should be noted that in other embodiments, either of systems 400 or 401 may be configured as individual units that may be affixed to an object. As such, individual bladders in bladder system may be affixed to an object, by any known manner. In this way, a diver may affix either one of system 400 or 401 to an object at the bottom of a lake or ocean, and inflate the bladders to provide positive horizontal buoyancy to float the object to the top of the water in a controlled manner. It should be noted that in these embodiments, the objects mass and overall volume will be stored in memory 416 to establish the natural buoyancy of the object. Therefore, stabilization controller 414 will execute instructions in buoyancy control instructions 424 to inflate the bladders sufficiently to provide positive horizontal buoyancy to float the object to the top of the water in a controlled manner.

In the embodiments discussed above with reference to FIG. 3, a system in accordance with aspects of the present disclosure is used to maintain a positive horizontal buoyancy to lift an object from the below water to the water surface or to retain positive horizontal buoyancy at the surface of the water. However, in other embodiments, a system in accordance with aspects of the present disclosure may operate in a controlled-submerged mode of operation so as to maintain horizontal buoyancy at a desired depth below the water's surface. This will now be described in greater detail with additional reference to FIGS. 5-6C.

Figure 5:
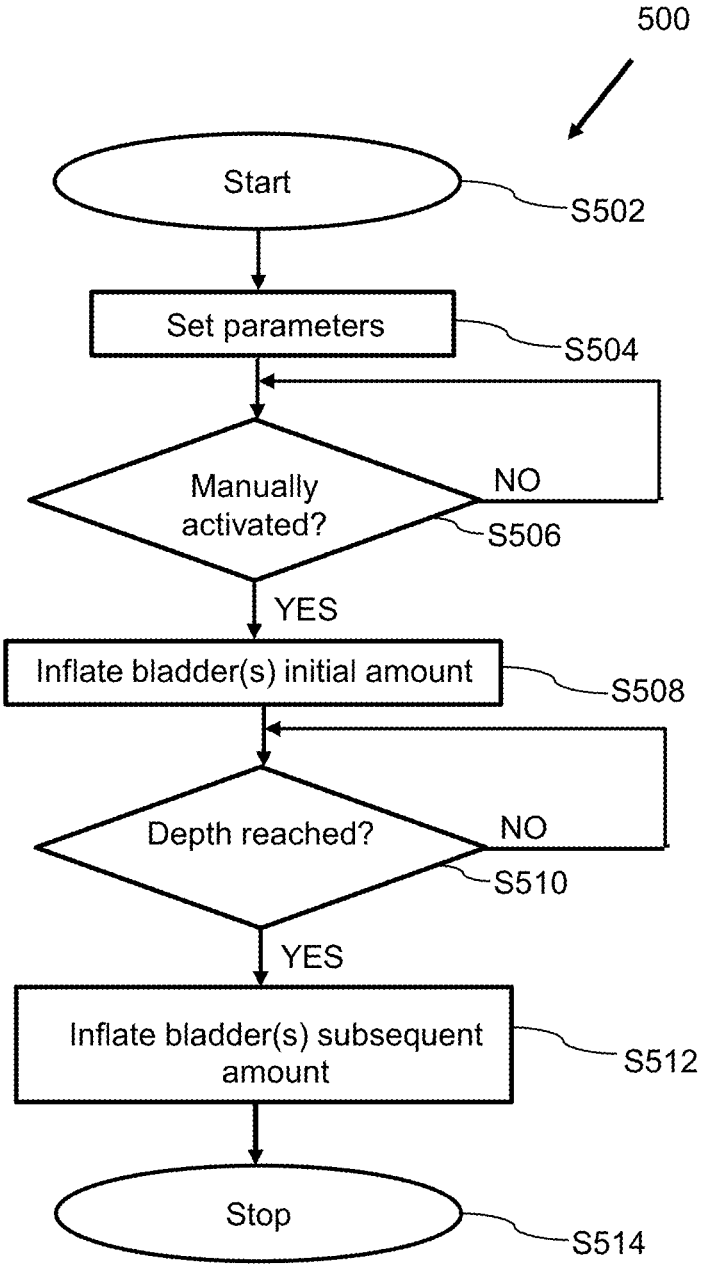
FIG. 5 illustrates a non-limiting example method of controlling depth and maintaining horizontal buoyancy in accordance with aspects of the present disclosure.

FIG. 5 illustrates a non-limiting example method 500 of controlling depth and maintaining horizontal buoyancy in accordance with aspects of the present disclosure.

As shown in the figure, method 500 starts (S502) and parameters are set (S504). For example, a user may input their BMI, the weight of any additional equipment to be carried and set the desired depth for swimming under water.

For example, returning to FIG. 4B, user 202 may user UI 415 to input the BMI of user 202, the weight of any additional equipment, such as diving equipment, and establish a desired depth at which to swim. Stabilization controller 414 will store the BMI value, the value of the weight of the equipment, and the value of the desired depth, say for example and just for purposes of discussion, three (3) feet, within memory 416. Stabilization controller 414 upon receiving this information, will know to operate in a controlled-submerged mode of operation.

A data structure, such as a look-up table, may be stored in memory 416 that associates an amount of gas needed to inflate of each of bladders 210, 212, and 214 to: obtain a negative horizontal buoyancy with a particular BMI and additional weight of any additional equipment, so as to enable a user to horizontally sink in the water; and obtain a zero horizontal buoyancy with a particular BMI and additional weight of any additional equipment, so as to enable a user to maintain a horizontal depth in water without sinking or rising to the surface.

Once set in memory 416, when needed, stabilization controller will be able to access memory 416 to determine the amount of gas needed for each bladder to maintain horizontal buoyancy of user 202 based on the BMI of user 202.

Returning to FIG. 5, after the depth is set (S504), it is determined whether the system is manually activated (S506). For example, the user may active the system once in the water.

Figure 6A:
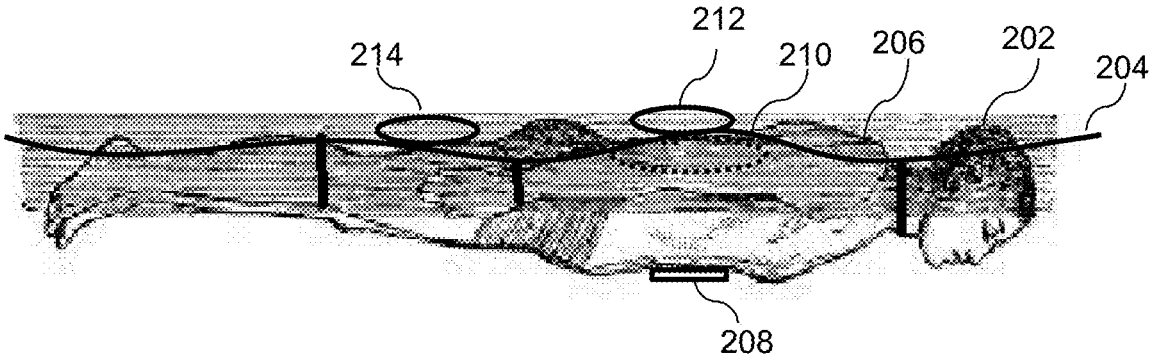
FIG. 6A illustrates a person, using a system in accordance with aspects of the present disclosure, maintaining horizontal buoyancy in accordance with aspects of the present disclosure at time $t_6$.

FIG. 6A illustrates user 202, using suit 206, maintaining horizontal buoyancy in accordance with aspects of the present disclosure at time $t_6$. Presume that once in water 204, user 202 activates system 400. Returning to FIG. 4B, activator 425 may send an activation signal 434 to stabilization controller 414.

Returning to FIG. 5, if it is determined that the system has not been manually activated (NO at S506), then method 500 waits until the system is manually activated (return to S506). However, if it is determined that the system has been manually activated (YES at S506), then the bladder system is inflated an initial amount (S508).

Returning to FIG. 4B, after stabilization controller 414 receives activation signal 434, in the controlled-submerged mode of operation, stabilization controller 414 will execute instructions in buoyancy control instructions 424 to inflate the bladders in bladder system 412.

In particular, upon receiving activation signal 434 from activator 425, stabilization controller 414 will access memory 416 to determine the amount of gas needed to be provided to the bladders within bladder system 412 so as to obtain a negative horizontal buoyancy with a particular BMI and additional weight of any additional equipment, so as to enable user 202 to horizontally sink in the water, based on the BMI of user 202 and the weight of the additional equipment.

Stabilization controller 414 will than transmit a valve control signal 450 instruct valve controller 406 to inflate the bladders in bladder system 412. Further, valve control signal 450 will indicate how much gas should be supplied to each bladder, respectively, to so as to enable user 202 to horizontally sink in the water.

Valve controller 406 will instruct gas supply 404 to supply gas to valve system 408. Valve controller 440 will additionally instruct the required valves in valve system 408 to open to supply gas from gas supply 404 to gas distribution system 410. Once in gas distribution system 410, the gas is then provided to bladders within bladder system 412. The bladders in bladder system 412 are then inflated, for example as shown in FIG. 6B.

Figure 6B:
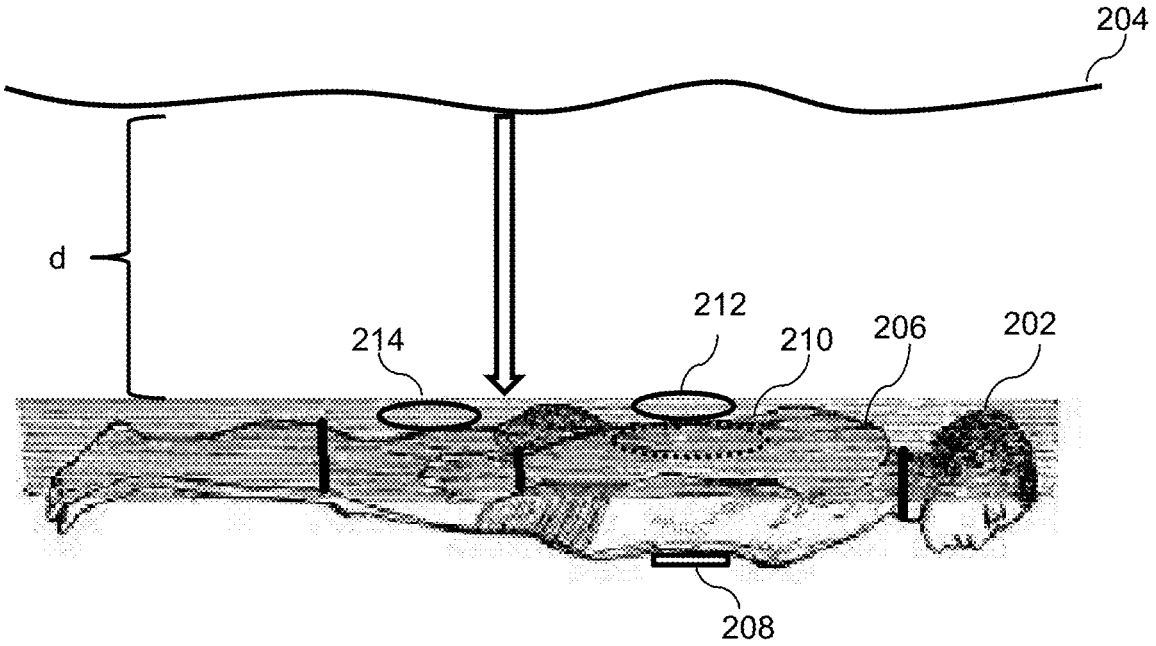
FIG. 6B illustrates the person of FIG. 6A maintaining a negative horizontal buoyancy in accordance with aspects of the present disclosure at time $t_7$.

FIG. 6B illustrates user 202 maintaining a negative horizontal buoyancy in accordance with aspects of the present disclosure at time $t_7$. It should be noted, that for purposes of discussion, it is presumed that user 202 with additional diving equipment will sink in water 204. As such, although bladders 210, 212, and 214 are inflated, the overall additional buoyancy provided by inflated bladders 210, 212, and 214 is not sufficient to keep user 202 from sinking in water 204. However, in accordance with aspects of the present disclosure, user 202 with diving equipment is able to sink in a controlled horizontal orientation.

Returning to FIG. 5, after the bladder system is inflated an initial amount (S508), it is determined whether the set depth has been reached (S510). For example, depth detector 422 may provide a depth detection signal to stabilization controller 414.

In some embodiments, depth detector 422 is configured to output a depth detection signal at periodic intervals, a non-limiting example of which includes 5 second intervals. The depth detection signal includes a depth value indicating the depth at which user 202 is below the surface of water 204. In these embodiments, stabilization controller 414 may compare the value of the depth as reported in the depth detection signal with the depth previously set by user 202 (S504).

In some embodiments, depth detector 422 is configured to output a depth detection signal when a detected depth value surpasses depth previously set by user 202 (S504). For example, in these embodiments, depth detector 422 may be configured to output a depth detection signal only when the detected depth reached 3 feet.

Returning to FIG. 5, if it is determined that the set depth has not reached (NO at S510), then method 500 waits until the set depth has been reached (return to S510). At this stage, user 202 will continue to sink down in water 204 in a controlled horizontal orientation. However, if it is determined that the set depth has been reached (YES at S510), then the bladder system is inflated a subsequent amount (S512).

Returning to FIG. 4B, after stabilization controller 414 determines that the set depth has been reached, stabilization controller 414 will execute instructions in buoyancy control instructions 424 to inflate the bladders in bladder system 412.

In particular, stabilization controller 414 will access memory 416 to determine the amount of gas needed to be provided to the bladders within bladder system 412 so as to obtain a zero horizontal buoyancy with the BMI of user 202 and the additional weight the additional equipment, so as to enable user 202 to maintain a horizontal depth in water 204 without sinking or rising to the surface.

Stabilization controller 414 will than transmit a valve control signal 450 instruct valve controller 406 to inflate the bladders in bladder system 412. Further, valve control signal 450 will indicate how much gas should be supplied to each bladder, respectively, to so as to enable user 202 to maintain a horizontal depth in water 204 without sinking or rising to the surface.

Valve controller 406 will instruct gas supply 404 to supply gas to valve system 408. Valve controller 440 will additionally instruct the required valves in valve system 408 to open to supply gas from gas supply 404 to gas distribution system 410. Once in gas distribution system 410, the gas is then provided to bladders within bladder system 412. The bladders in bladder system 412 are then inflated, for example as shown in FIG. 6C.

Figure 6C:
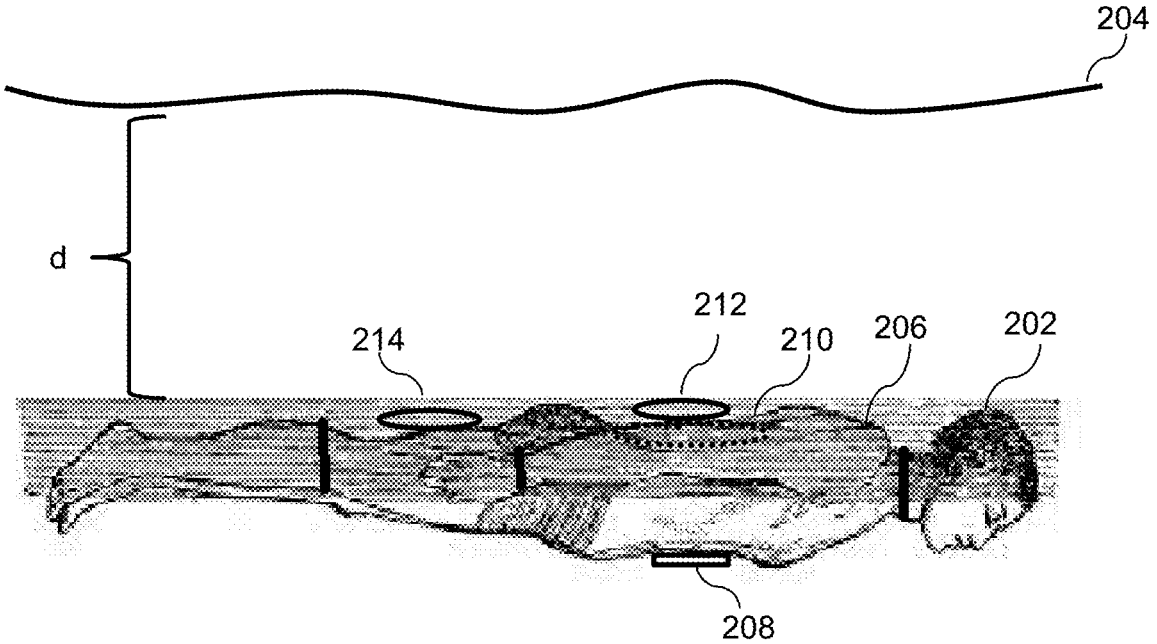
FIG. 6C illustrates the person of FIG. 6A maintaining a zero horizontal buoyancy at a controlled depth in accordance with aspects of the present disclosure at time $t_8$.

FIG. 6C illustrates user 202 maintaining a zero horizontal buoyancy at a controlled depth, d, in accordance with aspects of the present disclosure at time $t_8$.

Returning to FIG. 5, after the bladder system is inflated a subsequent amount (S512), method 500 stops (S514). At this point, user 202 is able to swim at a controlled depth within water 204, while easily maintaining a controlled buoyancy.

In the above described non-limiting examples of embodiments, BMI is used as a proxy for mass and volume to determine buoyancy. However, in other embodiments, other parameters may be used to determine buoyancy, such as weight, mass, density and combinations thereof.

In the above described non-limiting examples of embodiments, a suit having bladders covers a user to below the knee. However in other embodiments, a suit in accordance with aspects of the present disclosure may cover the entire leg. Further, in some of these embodiments, a suit in accordance with aspects of the present disclosure may additionally cover the feet. In any of the above discussed embodiments, additional bladders may be incorporated into the suit to provide additional buoyancy to the user. In a non-limiting example embodiment, a suit may include additional bladders located at the ankles of the user to provide additional buoyancy to provide support for the lower portion of the legs or feet.

It should be noted that a system for providing controlled horizontal buoyancy in accordance with aspects of the present disclosure may be used for inanimate objects, such as automobiles, houses, tools, planes, storage containers, etc. In such an application, a system for providing controlled horizontal buoyancy in accordance with aspects of the present disclosure may prevent an inanimate object from sinking. This would prevent damage of property or person below the sinking object. Ideally, it is desirable to prevent such items from sinking, particularly, in emergencies such as flooding or accidental capsizing.

The operations disclosed herein may constitute algorithms that can be effected by software, applications (apps, or mobile apps), or computer programs. The software, applications, computer programs can be stored on a non-transitory computer-readable medium for causing a computer, such as the one or more processors, to execute the operations described herein and shown in the drawing figures.

The foregoing description of various preferred embodiments have been presented for purposes of illustration and description. It is not intended to be exhaustive or to limit the invention to the precise forms disclosed, and obviously many modifications and variations are possible in light of the above teaching. The example embodiments, as described above, were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. An aquatic system for use with an object, said aquatic system comprising:

a parameter detector being configured to detect a parameter of the object and to output an activation signal based on the detected parameter;

an inflatable bladder being configured to inflate with a gas to displace a volume of water when the object is in the water;

a memory having instructions stored therein; and a stabilization controller being configured execute the instructions to cause said inflatable bladder to inflate so as to establish horizontal buoyancy of the object based on the activation signal.

2. The aquatic system of claim 1, for use with a person as the object, said aquatic system further comprising:

a suit configured to substantially cover the person between a knee and a head, wherein said parameter detector comprises a biometric parameter detector configured to detect a biometric parameter of the person, said biometric parameter detector being disposed at said suit, wherein said inflatable bladder is disposed at said suit, wherein said memory is disposed at said suit, and wherein said stabilization controller is disposed at said suit.

3. The aquatic system of claim 2, further comprising:

a second inflatable bladder disposed at said suit and being configured to inflate with a second gas to displace a second volume of water when the person is in the water, wherein said stabilization controller is additionally configured to cause said second inflatable bladder to inflate so as to establish the horizontal buoyancy of the person.

4. The aquatic system of claim 3, wherein said inflatable bladder is disposed at said suit at one location of a group of locations consisting of a first area near a chest of the person, a second area near a stomach of the person, a third area near a back of the person, a fourth area near a front of a thigh of the person, and a fifth area near a back of a thigh of the person, and wherein said second inflatable bladder is disposed at said suit at a different one location of the group of locations.

5. The aquatic system of claim 4:

a third inflatable bladder, wherein said suit is additionally configured to substantially cover the person between an ankle and the head, and wherein said third inflatable bladder is disposed at said suit at one location of the ankle.

6. The aquatic system of claim 1, for use with a person as the object, said aquatic system further comprising:

a second inflatable bladder configured to inflate with a second gas to displace a second volume of water when the person is in the water;

a first attachment piece configured to detachably fasten said inflatable bladder to the person at one location of a group of locations consisting of a first area near a chest of the person, a second area near a stomach of the person, a third area near a back of the person, a fourth area near a front of a thigh of the person, and a fifth area near a back of a thigh of the person; and a second attachment piece configured to detachably fasten said second inflatable bladder to the person at a different one location of the group of locations, wherein said stabilization controller is additionally configured to cause said second inflatable bladder to inflate so as to establish the horizontal buoyancy of the person.

7. The aquatic system of claim 2, wherein said biometric parameter detector is configured to detect, as the biometric parameter, at least one parameter of the group of parameters comprising body temperature, blood pressure, heart rate, salt concentration, a change in body temperature, a change in blood pressure, a change in heart rate, a change in salt concentration, and combinations thereof.

8. The aquatic system of claim 7, wherein said biometric parameter detector is configured to output the activation signal when a value of the detected biometric parameter meets a predetermined threshold value.

9. The aquatic system of claim 1, wherein said stabilization controller is additionally configured to:

cause said inflatable bladder to inflate an initial amount so as to establish an initial negative horizontal buoyancy of the object so as to cause the object to horizontally sink in the water; and subsequently cause said inflatable bladder to inflate a subsequent amount so as to establish a subsequent zero horizontal buoyancy of the object so as to cause the object to maintain a horizontal position at a predetermined depth in the water.

10. The aquatic system of claim 1, further comprising:

a first radio configured to transmit the activation signal;

a second radio configured to receive the activation signal;

a first attachment piece housing said parameter detector and said first radio and being configured to detachably fasten to the object at a first location;

a second attachment piece housing said stabilization controller and said second radio and being configured to detachably fasten to the object; and a third attachment piece being configured to detachably fasten said inflatable bladder to the object at a second location.

* * * * *